US010629370B2

(12) United States Patent
Inuzuka et al.

(10) Patent No.: US 10,629,370 B2
(45) Date of Patent: Apr. 21, 2020

(54) PRODUCTION METHOD OF COMPACT

(71) Applicant: TOYOTA JIDOSHA KABUSHIKI KAISHA, Toyota-shi, Aichi-ken (JP)

(72) Inventors: Tomonori Inuzuka, Toyota (JP); Akira Kano, Toyota (JP)

(73) Assignee: TOYOTA JIDOSHA KABUSHIKI KAISHA, Toyota-shi, Aichi-ken (JP)

( * ) Notice: Subject to any disclaimer, the term of this patent is extended or adjusted under 35 U.S.C. 154(b) by 617 days.

(21) Appl. No.: 15/202,176

(22) Filed: Jul. 5, 2016

(65) Prior Publication Data

US 2017/0011848 A1 Jan. 12, 2017

(30) Foreign Application Priority Data

Jul. 10, 2015 (JP) ..... 2015-138220

(51) Int. Cl.

*H01F 41/02* (2006.01)
*B22F 3/02* (2006.01)
*H01F 1/057* (2006.01)

(52) U.S. Cl.

CPC ..... *H01F 41/0266* (2013.01); *B22F 3/02* (2013.01); *B22F 2003/026* (2013.01); *C22C 2202/02* (2013.01); *H01F 1/0577* (2013.01)

(58) Field of Classification Search

CPC ..... H01F 41/0266; H01F 1/0577; B22F 3/02; B22F 2003/026; C22C 2202/02

See application file for complete search history.

(56) References Cited

U.S. PATENT DOCUMENTS 3,739,445 A * 6/1973 Gabriel ..... B22F 3/14 148/284
5,162,063 A * 11/1992 Shinoda ..... B22F 3/14 148/101

(Continued)

FOREIGN PATENT DOCUMENTS

JP 09-104902 A 4/1997
JP 09-124372 A 5/1997

(Continued)

OTHER PUBLICATIONS

Busch, Christian. Lubricants, 9. Solid Lubricants, Wiley-VCH: Weinheim, 2012 (Year: 2012).*

(Continued)

*Primary Examiner* — Kevin E Yoon
*Assistant Examiner* — Ryan L Heckman
(74) *Attorney, Agent, or Firm* — Sughrue Mion, PLLC

(57) ABSTRACT

The method including: applying a graphite-based lubricant to a cavity surface of a die; forming a first graphite-based powder layer by disposing graphite-based powder that does not contain a binder on a cavity surface of a lower punch, forming a magnet powder body by putting magnet powder on the first graphite-based powder layer, and forming a second graphite-based powder layer by disposing graphite-based powder that does not contain a binder on the magnet powder body; and producing a compact by performing press forming using the lower punch and a upper punch while heating the magnet powder body surrounded by the graphite-based lubricant applied to the cavity surface of the die, the first graphite-based powder layer, and the second graphite-based powder layer, and releasing the compact from a forming die.

12 Claims, 6 Drawing Sheets

(56) References Cited

U.S. PATENT DOCUMENTS

| | | | | | |
|---|---|---|---|---|---|
| 5,641,363 | A * | 6/1997 | Fukuno | B22F 3/1103 | 148/103 |
| 5,682,591 | A * | 10/1997 | Inculet | B21J 3/00 | 419/37 |
| 2010/0135841 | A1 * | 6/2010 | Nakai | B22F 3/02 | 419/38 |

FOREIGN PATENT DOCUMENTS

| | | | | | |
|---|---|---|---|---|---|
| JP | 09124372 | A | * | 5/1997 | H01F 1/0576 |
| JP | 2001300790 | A | | 10/2001 | |
| JP | 2004342937 | A | | 12/2004 | |
| JP | 2013241637 | A | * | 12/2013 | |
| JP | 2013241637 | A | | 12/2013 | |

OTHER PUBLICATIONS

Hanada, K., et al. "Graphite Coating of Tool Steel by Pressure Spraying." Journal of Materials Processing Technology, vol. 164-165, 2005, pp. 856-861 (Year: 2005).*

* cited by examiner

PRODUCTION METHOD OF COMPACT

INCORPORATION BY REFERENCE

The disclosure of Japanese Patent Application No. 2015-138220 filed on Jul. 10, 2015 including the specification, drawings and abstract is incorporated herein by reference in its entirety.

BACKGROUND OF THE INVENTION

1. Field of the Invention

The present invention relates to a production method of a compact which is a precursor of a rare-earth magnet.

2. Description of Related Art

A rare-earth magnet made by using rare earth elements such as lanthanoids is also called a permanent magnet, and applications thereof include, as well as motors included in hard disks and MRIs, driving motors for hybrid vehicles, electric vehicles, and the like.

Indexes of the magnetic performance of rare-earth magnets include remanent magnetization (remanent flux density) and coercivity. As the amount of generated heat increases due to a reduction in the size of a motor and a high current density, there is a higher demand for rare-earth magnets with heat resistance in use. Therefore, one of the most important research subjects in the related art technical field is how to maintain the magnetic characteristics of a magnet in use at high temperatures.

Rare-earth magnets include, as well as a general sintered magnet in which grains (main phase) forming the structure are on the scale of 3 μm to 5 μm, a nanocrystalline magnet in which grains are made finer to reach a nanoscale of about 50 nm to 300 nm.

A general example of a production method of a rare-earth magnet will be described. Fine powder (magnet powder) is produced by rapidly cooling, for example, Nd—Fe—B-based molten metal such that it solidifies, the magnet powder is put in the cavity of a forming die constituted by a die and upper and lower punches which slide inside the die, and the magnet powder is subjected to press forming to produce a compact. Next, the compact is compressed in a high-temperature atmosphere to be densified and produce a sintered body. The sintered body is subjected to hot working so as to be provided with magnetic anisotropy such that a rare-earth magnet (oriented magnet) is produced in this method. In addition, as the hot working, extrusion such as backward extrusion or forward extrusion, upsetting (forging), or the like is applied.

Regarding the production of the compact using the forming die described above, Japanese Patent Application Publication No. 9-104902 (JP 9-104902 A) discloses a powder forming method in which forming is performed by spraying a solid lubricant, which is formed of a fatty acid or metallic soap and is heated to its melting point or higher to be melted, onto either one or both of magnet powder and the cavity surface of a forming die to form a coating of the lubricant. According to this powder forming method, the properties and workability of the compact can be improved.

However, in the method of forming the compact by applying the lubricant to the cavity surface of the forming die as in the powder forming method described in JP 9-104902 A, after forming the compact, the upper and lower punches adhere to the compact when the compact is released from the forming die, and there is a possibility that the compact may be broken when the upper and lower punches are separated from the compact.

SUMMARY OF THE INVENTION

The present invention provides a production method of a compact in which the compact is prevented from being broken when the compact is released from a forming die.

According to an aspect of the present invention, there is provided a production method of a compact in which a forming die is constituted by a die, an upper punch and a lower punch, and the upper punch and the lower punch slide inside the die, and the forming die defines a cavity with the die, the upper punch and the lower punch, the method including: applying a graphite-based lubricant to a cavity surface of the die which faces the cavity; forming a graphite-based powder layer by disposing graphite-based powder that does not contain a binder on a cavity surface of the lower punch which faces the cavity, forming a magnet powder body by putting magnet powder on the graphite-based powder layer, and forming a graphite-based powder layer by disposing graphite-based powder that does not contain a binder on the magnet powder body; and producing a compact by performing press forming using the lower punch and the upper punch while heating the magnet powder body surrounded by the graphite-based lubricant applied to the cavity surface of the die and the upper and lower graphite-based powder layers, and releasing the compact from the forming die.

In the production method according to the aspect of the present invention, the graphite-based lubricant is applied to the cavity surface of the die, the graphite-based powder that does not contain a binder (binderless) is disposed on the cavity surface of the lower punch, and the graphite-based powder that does not contain a binder is also disposed on the magnet powder body (the cavity surface of the upper punch). In this state, the magnet powder body is subjected to press forming using the upper and lower punches while being heated, thereby producing the compact.

Therefore, in the produced compact, a layer in which the solvent is volatilized and the remaining graphite-based powder is fixed during the press forming is formed at the side surface thereof, and the binderless graphite-based powder layers which are similarly fixed during the press forming are formed at the upper and lower surfaces.

Therefore, in a case where the compact receives a force which would break the compact when released from the forming die, the graphite-based powder layers which do not contain a binder and have low strength break. Therefore, the compact is prevented from being broken when the compact that adheres to the upper and lower punches is separated from the upper and lower punches.

In addition, when the produced compact is transferred to a separate forming die so as to be sintered in the subsequent sintering process (sintering and densifying processes), a layer of the graphite-based powder which is fixed during the press forming due to the volatilization of the solvent is formed around the side surface of the compact, and the graphite-based powder layers which are fixed during the press forming are also formed around the upper and lower surfaces of the compact. Therefore, there is no need to apply a lubricant to the cavity surface of the forming die. Moreover, since the compact is surrounded by the layer of the graphite-based powder and the graphite-based powder layers, the oxidation of the magnet powder body forming the compact can be suppressed.

Here, as the graphite-based lubricant, for example, a lubricant formed by including graphite powder in water or an organic solvent may be applied. In addition, graphite powder may also be applied as the graphite-based powder. The solvent included in the graphite-based lubricant may be of any type as long as the graphite-based lubricant is volatilized at a heating temperature during the press forming. Here, "being volatilized at a heating temperature during press forming" practically includes, not only volatilization during press forming, but also a case of volatilization before press forming at a heating temperature of a forming die which is pre-heated for the press forming.

In addition, the application of the graphite-based lubricant includes not only the application of the graphite-based lubricant in the literal sense of the words, but also spraying the graphite-based lubricant, and the like.

In addition, when the first graphite-based powder layer is formed by disposing the graphite-based powder that does not contain a binder on the cavity surface of the lower punch which faces the cavity, the magnet powder body is formed by putting the magnet powder on the first graphite-based powder layer, and the second graphite-based powder layer is formed by disposing the graphite-based powder that does not contain a binder on the magnet powder body, a pressure during the press forming may be set to 50 MPa or higher.

According to the inventors, this is based on the fact that in order to cause the magnet powder to be fixed in a transportable state during the press forming and in order to fix the graphite-based powder layers, the pressure is practically and preferably specified as being 50 MPa or higher.

A sintered body is produced by performing press forming on the compact produced in the production method according to the aspect of the present invention in a predetermined temperature atmosphere, such as high-temperature atmosphere, in sintering and densifying processes, and a rare-earth magnet is produced by performing hot working on the sintered body so as to provide magnetic anisotropy to the sintered body. In the rare-earth magnet, the oxidation of the magnet powder in the production process is effectively suppressed as described above. Therefore, the rare-earth magnet achieves excellent performance such as remanent magnetization and coercivity.

The first graphite-based powder layer and the second graphite-based powder layer may be formed of only the graphite-based powder.

The graphite-based lubricant may be a water-soluble graphite lubricant.

A film thickness of the graphite-based lubricant may be 10 μm or greater.

A sintered body may be produced by performing press forming on the compact in a predetermined temperature atmosphere in sintering and densifying processes, and a rare-earth magnet may be produced by performing hot working on the sintered body so as to provide magnetic anisotropy to the sintered body.

The compact may have an Nd—Fe—B-based main phase with a nanocrystalline structure and a grain boundary phase of an Nd—X alloy, where X is a metal element, the grain boundary phase being present around the main phase.

The Nd—X alloy constituting the boundary phase may be any one type of Nd—Co, Nd—Fe, Nd—Ga, Nd—Co—Fe, and Nd—Co—Fe—Ga or may be a mixture of at least two of Nd—Co, Nd—Fe, Nd—Ga, Nd—Co—Fe, and Nd—Co—Fe—Ga, and the Nd—X alloy may be in an Nd-rich state.

As is understood from the above description, in the production method of a compact according to the aspect of the present invention, the graphite-based lubricant is applied to the cavity surface of the die, the binderless graphite-based powder layers are formed on the cavity surfaces of the upper and lower punches, and the magnet powder body is subjected to press forming while being heated. Therefore, the layer of the graphite-based powder which is fixed during the press forming due to the volatilization of the solvent is formed around the side surface of the compact, and the graphite-based powder layers which are fixed during the press forming are also formed around the upper and lower surfaces of the compact. The binderless graphite-based powder layers fixed as described above do not adhere to the upper and lower punches, and thus the compact can be prevented from being broken when the compact is released from the forming die.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Hereinafter, an embodiment of a production method of a compact of the present invention will be described with reference to the drawings.

Figure 1:
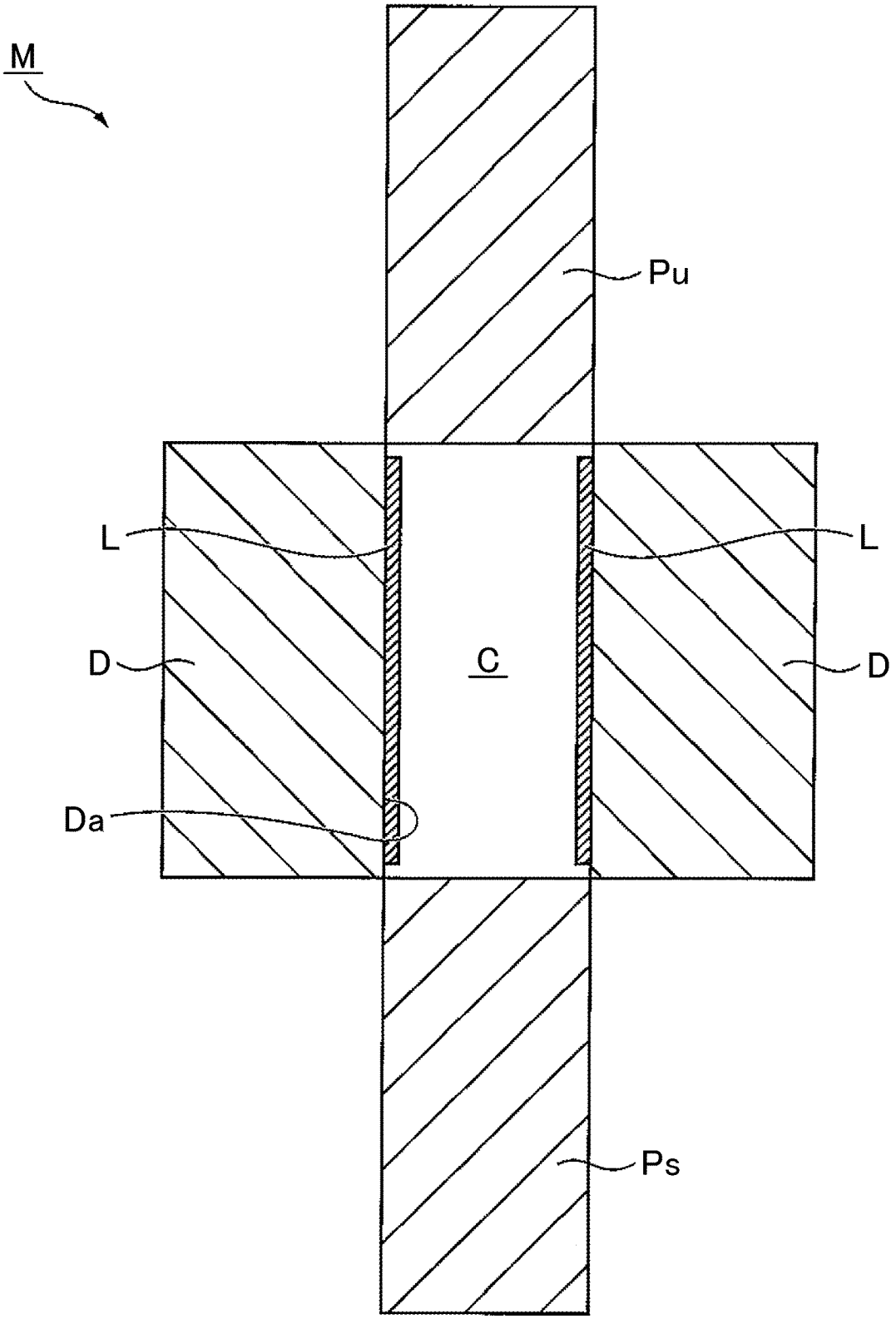
FIG. 1 is a schematic view illustrating a first step in a production method of a compact of the present invention.
Figure 2:
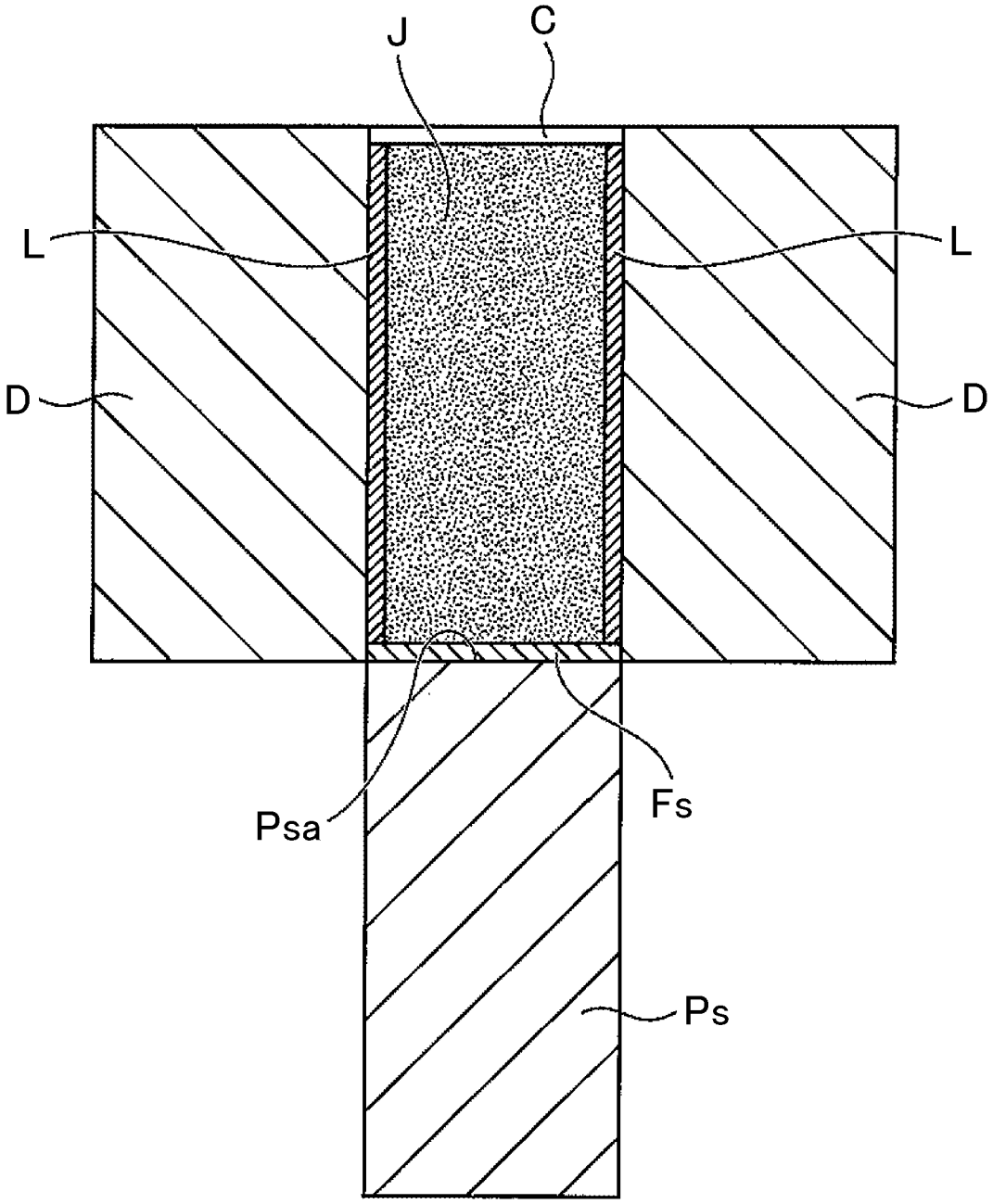
FIG. 2 is a schematic view illustrating a second step in the production method of a compact.
Figure 3:
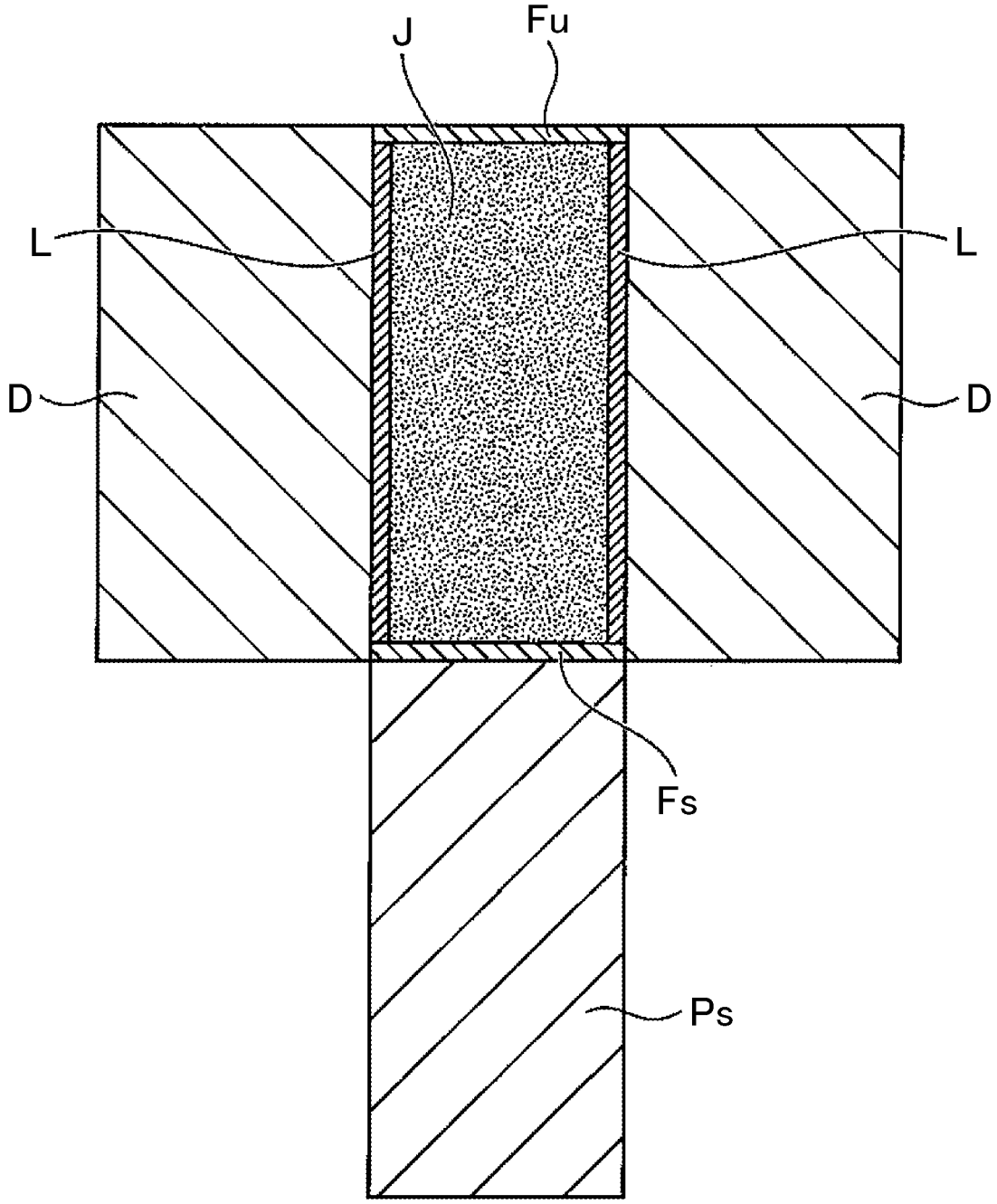
FIG. 3 is a schematic view illustrating the second step in the production method of a compact subsequent to FIG. 2.
Figure 4:
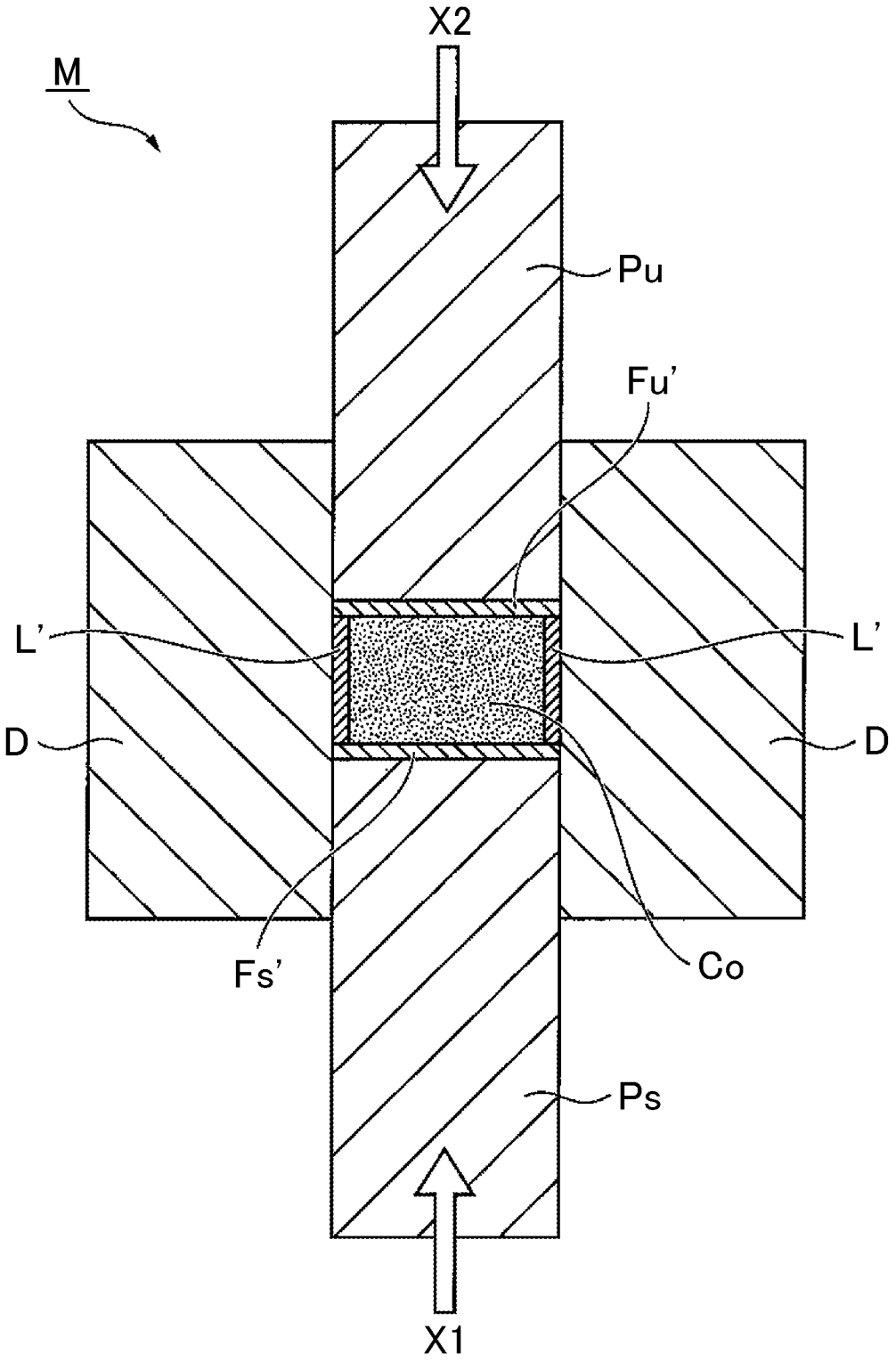
FIG. 4 is a schematic view illustrating a third step in the production method of a compact.
Figure 5:
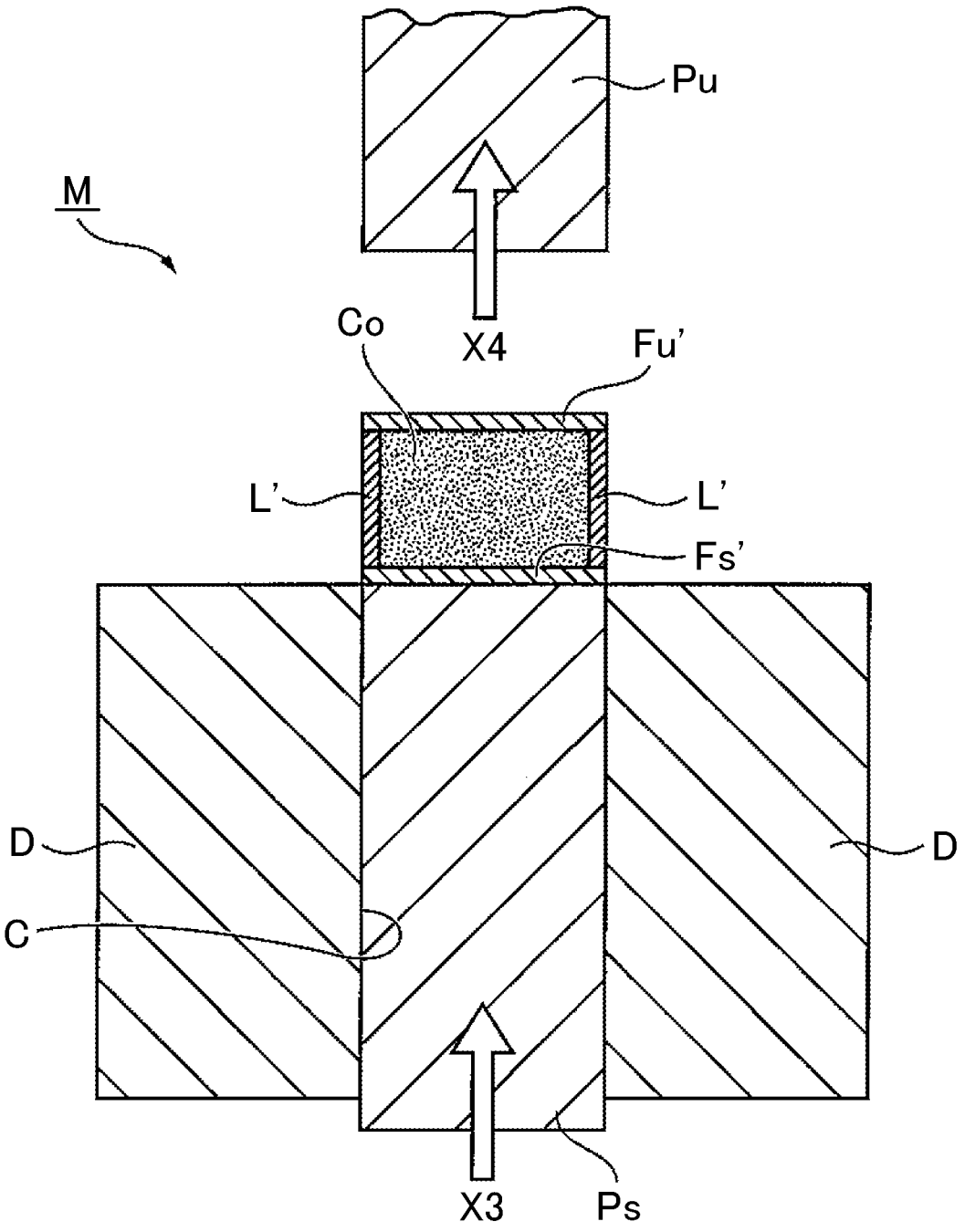
FIG. 5 is a schematic view illustrating the third step in the production method of a compact subsequent to FIG. 4.

(Embodiment of Production Method of Compact) FIG. 1 is a schematic view illustrating a first step in the production method of a compact of the present invention, FIGS. 2 and 3 are schematic views sequentially illustrating a second step in the production method, and FIGS. 4 and 5 are schematic views sequentially illustrating a third step in the production method.

First, as illustrated in FIG. 1, a forming die M which is constituted by a die D, an upper punch Pu and a lower punch Ps, and the upper punch Pu and the lower punch Ps slide inside the die D, and the forming die M defines a cavity C with the die D, the upper punch Pu, and the lower punch Ps is prepared.

Next, a graphite-based lubricant L is applied to a cavity surface Da of the die D included in the forming die M (first step).

Here, as the graphite-based lubricant L, a water-soluble graphite lubricant formed by dispersing graphite powder in water as a solvent may be applied.

Next, as illustrated in FIG. 2, a graphite-based powder layer Fs formed of graphite-based powder is formed on the cavity surface Psa of the lower punch Ps.

Here, graphite powder is applied as the graphite-based powder, and the graphite-based powder layer Fs does not contain a binder at all and is formed of only the graphite-based powder.

Next, magnet powder is put in the cavity C on the formed graphite-based powder layer Fs, thereby forming a magnet powder body J.

As a production method of the magnet powder used here, first, an alloy ingot is subjected to high-frequency induction melting by a melt spinning method using a single roll in a furnace (not illustrated) which is reduced in pressure to 50 kPa or lower, and the molten metal having a composition for a rare-earth magnet is ejected toward a copper roll, thereby producing a rapidly cooled thin band (rapidly cooled ribbon). Next, the rapidly cooled thin band which is produced is coarsely crushed to produce the magnet powder. In addition, the particle size of the magnet powder is adjusted to be in a range of 75 μm to 300 μm.

When the magnet powder body J is formed in the cavity C, as illustrated in FIG. 3, a graphite-based powder layer Fu made of graphite-based powder is formed on the magnet powder body J.

Like the graphite-based powder layer Fs, the graphite-based powder layer Fu does not contain a binder at all and is formed of only the graphite-based powder.

As described above, in the cavity C, the side surface of the magnet powder body J is surrounded by the graphite-based lubricant L, and the upper and lower surfaces of the magnet powder body J are surrounded by the "binderless" graphite-based powder layers Fu, Fs (second step).

Next, as illustrated in FIG. 4, the forming die M is heated, the lower punch Ps and the upper punch Pu are caused to slide in the die D (X1 direction and X2 direction), and the magnet powder body J is subjected to press forming, thereby producing a compact Co.

Here, the pressure during the press forming is set to a pressure of 50 MPa or higher as a pressure at which the compact Co is fixed to a degree that the shape thereof can be maintained during subsequent handling. For example, the magnet powder body J is subjected to press forming at a pressure in a range of about 50 MPa to 200 MPa.

The solvent contained in the graphite-based lubricant is volatilized through heating during the press forming, and the remaining graphite-based powder is fixed during the press forming such that a layer L' of the graphite-based powder is formed at the side surface of the compact Co. For example, the heating temperature (the temperature of the forming die) is set to 110±10° C., and water which is the solvent of the water-soluble graphite lubricant is volatilized at the heating temperature. Since the water-soluble graphite lubricant is applied to the heated forming die, water as the solvent starts to be volatilized immediately after being applied. Depending on the time from the putting of the powder to the start of the press forming, there may be cases where the volatilization ends before the start of the press forming.

In addition, at the upper and lower surfaces of the compact Co, graphite-based powder layers Fu', Fs' formed of the graphite-based powder layers Fu, Fs which are fixed during the press forming are formed. In addition, under a pressure of 50 MPa or higher as described above, the layer L' of the graphite-based powder and the graphite-based powder layers Fu', Fs' which are fixed in the periphery of the compact Co are fixed to a degree that the shape can be maintained during subsequent handling.

When the compact Co is produced, as illustrated in FIG. 5, the lower punch Ps is caused to further slide upward (X3 direction) so as to move the compact Co toward the upper side of the cavity C, such that the upper punch Pu is removed (X4 direction).

During the removal, the binderless graphite-based powder layer Fu' at the upper surface of the compact Co is not strongly adhered to the upper punch Pu, and thus the upper punch Pu is rapidly detached from the graphite-based powder layer Fu'. Accordingly, the compact can be prevented from being broken when the two are separated from each other in a case of being strongly adhered to each other.

Similarly, the binderless graphite-based powder layer Fs' at the lower surface of the compact Co is not strongly adhered to the lower punch Ps, and thus the lower punch Ps is rapidly detached from the graphite-based powder layer Fs'.

As described above, the compact Co formed during the press forming can be released from the forming die M without breakage (third step).

In addition, since the periphery of the compact Co produced in the third step is surrounded by the layer L' of the graphite-based powder and the graphite-based powder layers Fu', Fs', when the compact Co is transferred to a separate forming die in which subsequent sintering and densifying processes are performed, there is no need to apply a lubricant to the inner surface of the forming die.

Furthermore, since the compact Co is surrounded by the layer L' of the graphite-based powder and the graphite-based powder layers Fu', Fs', oxidation thereof is suppressed.

In addition, since the magnet powder has a large number of voids, the magnet powder body infiltrates into the voids during the press forming and most of the voids disappear. Therefore, the height of the compact Co which is subjected to the press forming becomes lower than the height of the initial magnet powder body J. On the other hand, the graphite-based lubricant L has substantially no voids therein or has an extremely small amount of voids. Accordingly, it is specified by the inventors that the thickness of the layer L' of the graphite-based powder formed during the press forming becomes greater than the thickness of the initial graphite-based lubricant L. Therefore, the layer L' of the graphite-based powder is ensured even during subsequent sintering and densifying processes for producing a sintered body and hot working for producing a rare-earth magnet.

For example, the produced compact Co has an Nd—Fe—B-based main phase with a nanocrystalline structure (with an average grain size of 300 nm or smaller, for example, grain sizes of about 50 nm to 200 nm) and a grain boundary phase of an Nd—X alloy, where X is a metal element, the grain boundary phase being present around the main phase. In addition, the Nd—X alloy constituting the boundary phase is formed of an alloy of Nd and at least one of Co, Fe, and Ga, and is, for example, any one type of Nd—Co, Nd—Fe, Nd—Ga, Nd—Co—Fe, and Nd—Co—Fe—Ga or is a mixture of at least two of Nd—Co, Nd—Fe, Nd—Ga, Nd—Co—Fe, and Nd—Co—Fe—Ga, and the Nd—X alloy is in an Nd-rich state.

The compact Co is transferred to a forming die (not illustrated), is compressed in the forming die set to about 700° C. to be densified, thereby producing a sintered body.

Even in the production process of the sintered body, the layer L' of the graphite-based powder and the graphite-based powder layers Fu', Fs' that surround the periphery of the compact Co remain, and thus the oxidation of the sintered body is also suppressed.

The sintered body is further transferred to a separate forming die and is subjected to hot working including extrusion such as backward extrusion or forward extrusion, upsetting (forging), or the like such that the sintered body is provided with magnetic anisotropy and a rare-earth magnet is produced.

In the rare-earth magnet produced as described above, the oxidation of an intermediate product in the production process is suppressed. Therefore, the rare-earth magnet achieves excellent performance such as remanent magnetization and coercivity.

(Experiment for Comparison between Film Thickness of Graphite-Based Lubricant Applied To Cavity Surface of Die for Compact, Film Thickness of Layer of Graphite-Based Powder at Side Surface of Produced Compact, and Film Thickness of Layer of Graphite-Based Powder at Side Surface of Sintered Body, and Results) The inventors conducted an experiment for comparison between the film thickness of the graphite-based lubricant applied to the cavity surface of the die for the compact, the film thickness of the layer of the graphite-based powder at the side surface of the produced compact, and the film thickness of the layer of the graphite-based powder at the side surface of the sintered body.

As the raw material powder, neodymium-based rare-earth magnet powder (particle size of 45 μm to 300 μm) was used and was compacted. In addition, a die having a cross-sectional shape of 28.68 mm×12.24 mm as the internal shape was prepared. The die was heated in a heating furnace at 150° C. for 3 minutes, and a water-soluble graphite-based lubricant (Prophite 15FU (with a graphite average particle size of 20 μm and a concentration of about 10%) manufactured by Nippon Graphite Industries, ltd.) was sprayed onto the inner surface thereof. A lower punch was inserted into the die, and graphite powder, magnet powder, and graphite powder were sequentially put in the cavity thereof. Thereafter, an upper punch was inserted into the die, and press forming was performed at a forming pressure of 100 MPa, thereby obtaining a compact. The compact is a rectangular parallelepiped having a size of 12.9 mm×29.4 mm×14.5 mm. Thereafter, the compact was released from the die, and was subjected to sintering (also referred to as hot press forming or densification) in a subsequent process. During the sintering, hot press forming was performed by heating the die and the upper and lower punches to 700° C., injecting a preliminary compact into the cavity in an Ar gas atmosphere (with an oxygen concentration of 100 ppm in the atmosphere), then holding the preliminary compact in the die for 80 seconds to increase the temperature of the center portion of the preliminary compact to about 500° C., and thereafter pressing the preliminary compact at a forming pressure of 200 MPa. The size of the sintered body is 12.9 mm×29.4 mm×9.1 mm. The film thicknesses of the graphite-based lubricants at the side surfaces of the compact and the sintered body produced as described above and at the inner surface of the die were measured. Since the die is a die having four divided parts, in order to measure the film thickness, the die is disassembled and the side surface was measured by an optical microscope. In addition, regarding the film thicknesses of the compact and the sintered body, the vicinity of the center portion was cut, and the cross-section thereof was measured by the optical microscope.

Figure 6:
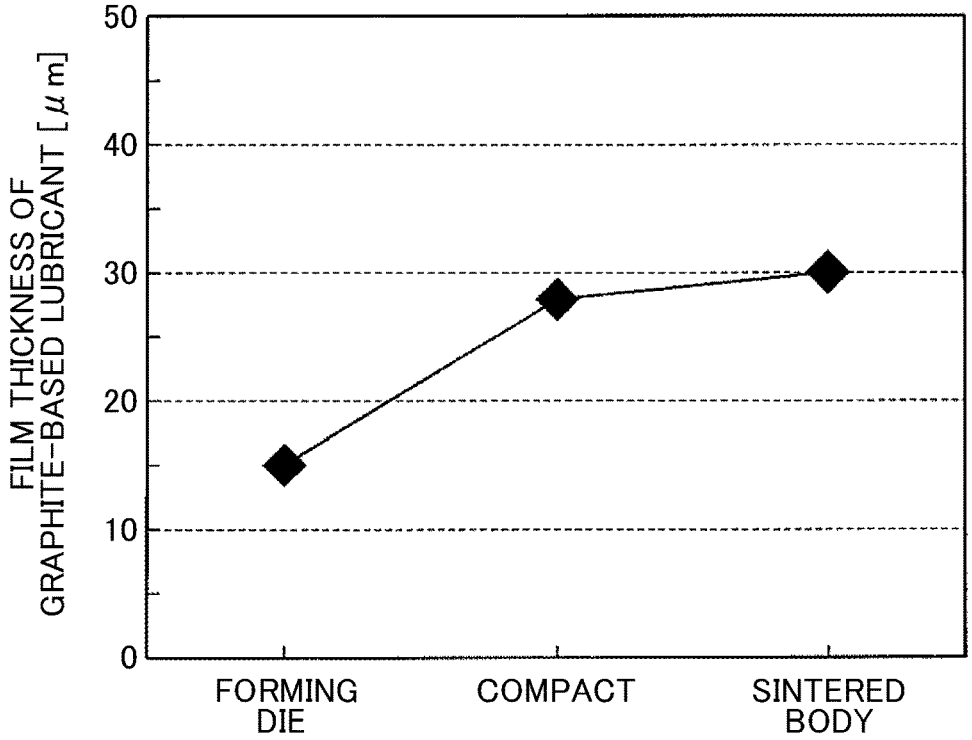
FIG. 6 is a diagram showing the results of an experiment for comparison between the film thickness of a graphite-based lubricant applied to a cavity surface of a die of a forming die, the film thickness of a layer of graphite-based powder at the side surface of the produced compact, and the film thickness of a layer of graphite-based powder at the side surface of a sintered body.

Experimental results are shown in FIG. 6. In FIG. 6, the film thickness of the graphite-based lubricant when being initially applied to the forming die was 15 μm, while the film thickness of the layer of the graphite-based powder formed on the surface of the produced compact was about 29 μm and had almost doubled.

Furthermore, it can be seen that the film thickness of the layer of the graphite-based powder formed on the surface of the sintered body produced in the subsequent sintering and densifying processes was 30 μm and was thus further increased. At this time, seizure had not occurred when the sintered body was released.

From the results, the film thickness of the graphite-based lubricant may be set to 10 μm or greater, and more preferably 15 μm or greater. In addition, the film thickness is increased because the dimensions of the compact formed from the powder and the sintered body formed from the compact in the pressing direction decrease and thus the film thickness at the side surface in a direction intersecting the pressing direction increases.

(Experiment for Specifying Relationship between Heating Temperature in Third Step and Amount of Increase in Oxygen Concentration in Compact, and Results) The inventors conducted an experiment to measure the amount of increase in oxygen concentration in the produced compact while varying the heating temperature during heating in the third step in the production method of the present invention.

The compact was produced in the above-described manner except that the forming temperature was changed. The forming temperature was 100° C., 130° C., and 150° C. After the lubricant layer on the surface of the obtained compact was removed, about 200 mg was cut from the center portion thereof. The oxygen concentration thereof was analyzed using a commercially available oxygen concentration analyzer.

Figure 7:
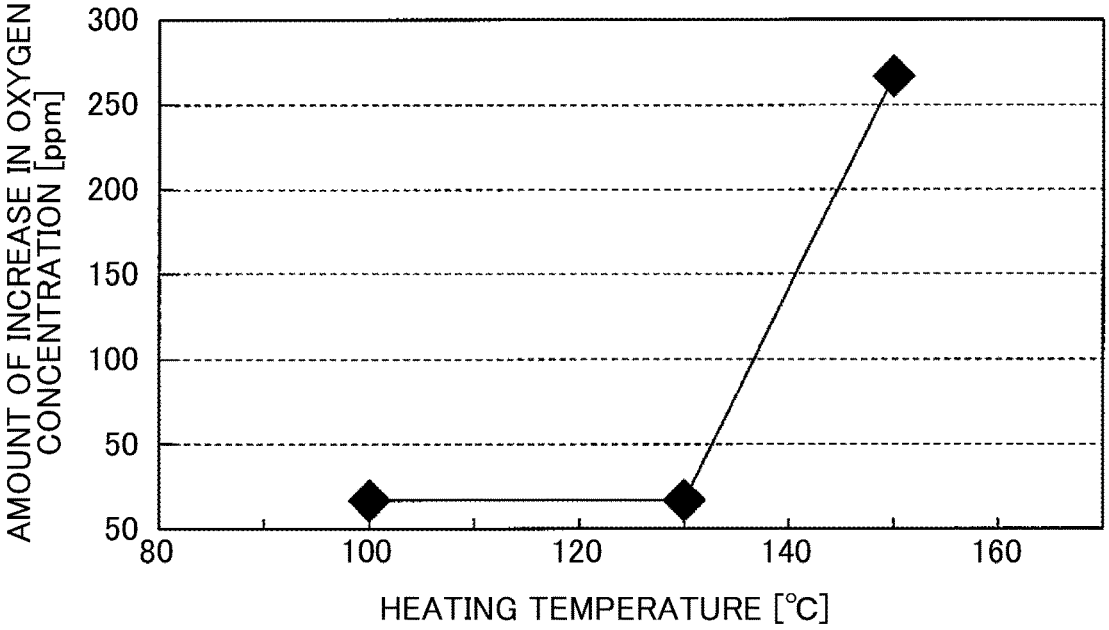
FIG. 7 is a view showing the results of an experiment for specifying the relationship between a heating temperature in the third step and the amount of increase in oxygen concentration in the compact.

Experimental results are shown in FIG. 7. From FIG. 7, it could be seen that at a heating temperature of 100° C. and 130° C., the amount of increase in oxygen concentration was 20 ppm and was extremely low, while at a heating temperature was 150° C., the amount of increase in oxygen concentration was 270 ppm, which is 13 times higher than the cases at 100° C. and 130° C.

From the experimental results, the heating temperature in the third step may be set to be in a range of 100° C. to 130° C.

While the embodiment of the present invention has been described in detail with reference to the drawings, specific configurations are not limited to this embodiment, and changes in design and the like are included in the present invention without departing from the gist of the present invention.

What is claimed is:

1. A production method of a compact in which a forming die is constituted by a die, an upper punch and a lower punch, and the upper punch and the lower punch slide inside the die, and the forming die defines a cavity with the die, the upper punch and the lower punch, the production method comprising:

spraying a graphite-based lubricant comprising a solvent to a cavity surface of the die which faces the cavity;

forming a first graphite-based powder layer by disposing graphite-based powder that does not contain a binder on a cavity surface of the lower punch which faces the cavity, forming a magnet powder body by putting magnet powder on the first graphite-based powder layer, the graphite-based powder that does not contain a binder being disposed on a cavity surface of the upper punch which faces the cavity, and forming a second graphite-based powder layer by disposing graphite-based powder that does not contain a binder on the magnet powder body; and producing a compact by performing press forming using the lower punch and the upper punch while heating the magnet powder body surrounded by the graphite-based lubricant applied to the cavity surface of the die, the first graphite-based powder layer, and the second graphite-based powder layer, and releasing the compact from the forming die.

2. The production method of a compact according to claim 1, wherein when the first graphite-based powder layer is formed by disposing the graphite-based powder that does not contain the binder on the cavity surface of the lower punch which faces the cavity, the magnet powder body is formed by putting the magnet powder on the first graphite-based powder layer, and the second graphite-based powder layer is formed by disposing the graphite-based powder that does not contain the binder on the magnet powder body, a pressure during the press forming is set to 50 MPa or higher.

3. The production method of a compact according to claim 1, wherein the first graphite-based powder layer and the second graphite-based powder layer are formed of only the graphite-based powder.

4. The production method of a compact according to claim 1, wherein the graphite-based lubricant comprises graphite powder dispersed in water.

5. The production method of a compact according to claim 1, wherein a film thickness of the graphite-based lubricant is 10 μm or greater.

6. The production method of a compact according to claim 1, wherein a sintered body is produced by performing press forming on the compact in a predetermined temperature atmosphere in sintering and densifying processes, and a rare-earth magnet is produced by performing hot working on the sintered body so as to provide magnetic anisotropy to the sintered body.

7. The production method of a compact according to claim 1, wherein the compact has an Nd—Fe—B-based main phase with a nanocrystalline structure and a grain boundary phase of an Nd—X alloy, where X is a metal element, the grain boundary phase being present around the main phase.

8. The production method of a compact according to claim 7, wherein the Nd—X alloy constituting the boundary phase is any one type of Nd—Co, Nd—Fe, Nd—Ga, Nd—Co—Fe, and Nd—Co—Fe—Ga or is a mixture of at least two of Nd—Co, Nd—Fe, Nd—Ga, Nd—Co—Fe, and Nd—Co—Fe—Ga, and the Nd—X alloy is in an Nd-rich state.

9. The production method of a compact according to claim 3, wherein the graphite-based lubricant comprises graphite powder dispersed in water.

10. The production method of a compact according to claim 1, wherein the second graphite-based powder layer does not adhere to the upper punch.

11. The production method of a compact according to claim 1, wherein the magnet powder is covered by the second graphite-based powder layer prior to press forming.

12. The production method of a compact according to claim 1, wherein the compact has an upper surface formed by the upper punch, a lower surface formed by the lower punch, and side surfaces formed by the die, and wherein a layer of the graphite-based lubricant in which the solvent has been volatilized during press forming is formed at the side surfaces of the compact and layers of the graphite-based powder that does not contain a binder are formed at the upper and lower surfaces of the compact.

* * * * *